United States Patent [19]

Oliver

[11] 4,093,225

[45] June 6, 1978

[54] ANCHORING DEVICE FOR CAPTIVE BALL AND CORD FOR A GAME

[75] Inventor: Robert John Oliver, Adelaide, Australia

[73] Assignee: Zimm-Zamm Aktiengesellschaft, Zurich, Switzerland

[21] Appl. No.: 729,775

[22] Filed: Oct. 5, 1976

[30] Foreign Application Priority Data

May 20, 1976 United Kingdom ..... 20955/76

[51] Int. Cl.[2] ..... A63B 69/00

[52] U.S. Cl. ..... 273/95 AA; 273/58 C

[58] Field of Search ..... 273/95 R, 95 A, 95 AA, 273/96 R, 97 R, 98, 1.5 R, 1.5 A, 25, 26 R, 26 E, 26 EA, 29 R, 29 A, 58 C; 16/108, 109

[56] References Cited

U.S. PATENT DOCUMENTS

| | | | |
|---|---|---|---|
| 2,458,668 | 1/1949 | Wood | 273/95 A X |
| 2,895,195 | 7/1959 | Ehmann | 16/108 |
| 3,107,094 | 10/1963 | Kfoury | 273/95 AA |
| 3,663,018 | 7/1969 | O'Leary | 273/58 C X |

FOREIGN PATENT DOCUMENTS

| | | | |
|---|---|---|---|
| 231,322 | 1/1964 | Austria. | |
| 7,131,094 | 11/1971 | Germany. | |
| 692,426 | 7/1965 | Italy | 273/95 AA |
| 358,792 | 10/1931 | United Kingdom. | |
| 395,099 | 7/1933 | United Kingdom. | |

*Primary Examiner*—William H. Grieb
*Attorney, Agent, or Firm*—Young & Thompson

[57] ABSTRACT

The invention is concerned with a marker for the anchoring device of a captive ball and cord in a game comprising a spiral mounted on a stand and a ball on a cord, the other end of which is associated with the spiral for relative movement therewith according to the direction in which the ball is hit, the marker providing a prominent visual indication to the players of the game of the location of the anchoring device relative to the spiral; the marker optionally serving to hold the cord to the spiral.

2 Claims, 5 Drawing Figures

ANCHORING DEVICE FOR CAPTIVE BALL AND CORD FOR A GAME

This invention relates to games of the kind comprising a stand supporting a spiral or equivalent structure and a ball on a cord, the other end of which is associated with the spiral, there being the possibility of relative movement between either the attachment of the ball and the spiral or between the spiral and the pole, according to the direction in which the ball is hit. The cord is preferably associated with the spiral by a suitable anchoring device.

During play of games of this type the players are concentrating on the fast-moving ball and it is not easy for them at the same time to watch the movement of the anchoring device in relation to the spiral or the top of the pole, which indicates their progress in winning or losing the game.

It is an object of the invention to minimise this difficulty.

According to the invention a marker is provided to constitute a prominent visual indication to the players of the relative position of the anchoring device on the spiral or of the spiral on the pole.

In a preferred form of the invention a funnel-shaped marker is provided at or near the anchoring device and this may be of a bright colour and sufficiently large to be easily seen.

The marker may be a conical ferrule which also serves to assist attachment of the cord to the anchoring device to the spiral.

Thus the cord may be passed through the attachment and the end returned through the conical interior of the ferrule. The knot is thus wedged into the ferrule. The ferrule may be sufficiently large and shaped to reduce the possibility of the cord being tangled in the spiral.

Further according to the invention the diameter of the ferrule at its wide end may be greater than the distance apart of the coils of the spiral. This serves to prevent the cord becoming snagged in the coils of the spiral.

An embodiment of the invention is described below with reference to the accompanying drawings in which.

Figures 1, 2, 3, 4, 5:
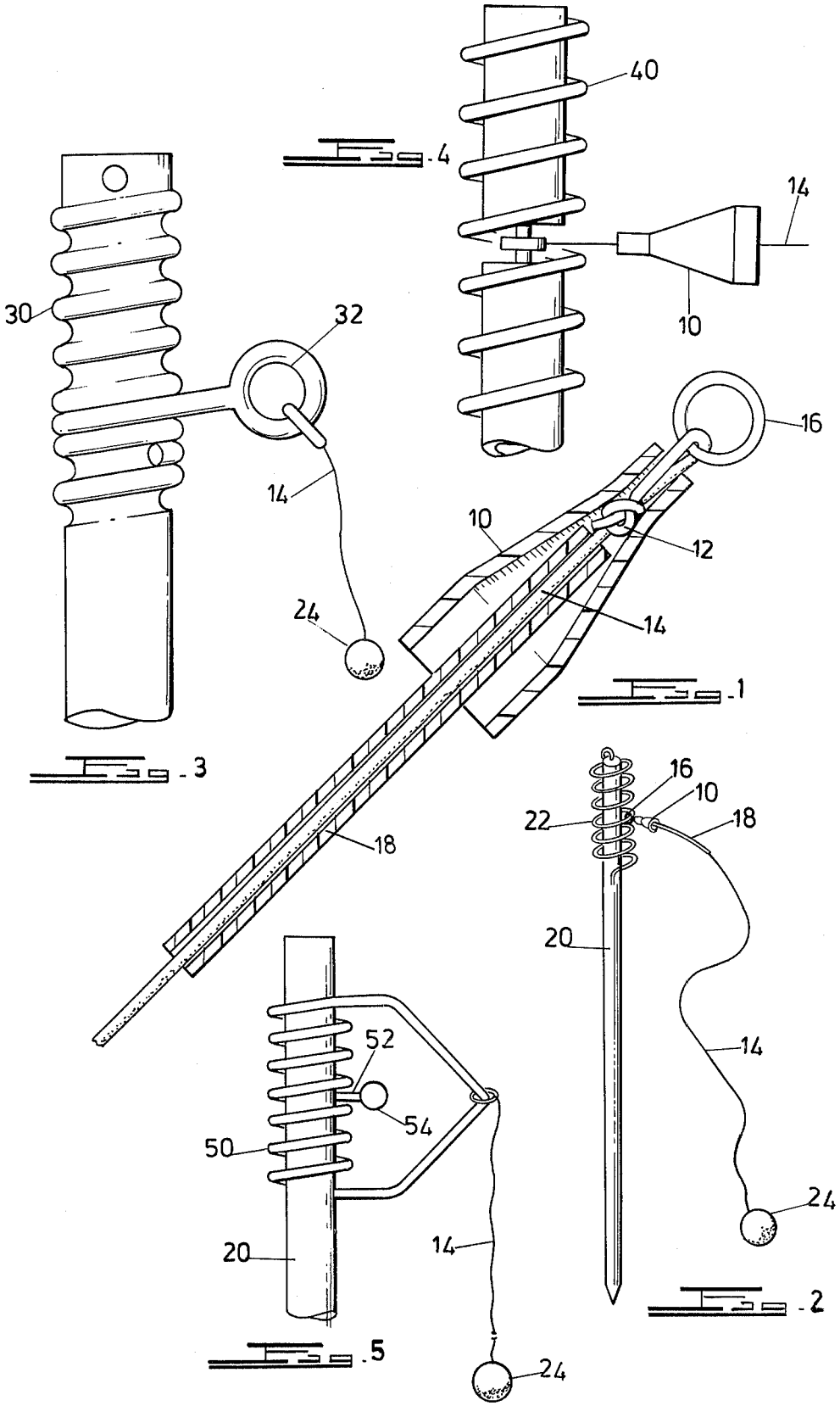
FIG. 1 is a cross-sectional view through an assembly including the marker.
FIG. 2 is a general perspective view of a game incorporating the invention.
FIGS. 3, 4 and 5 are alternative arrangements of the game including a marker.

In FIG. 1 a conical ferrule 10 is provided which serves to hold a knot 12 on the doubled-back cord 14 which holds the anchoring device 16. The anchoring device moves on a spiral of a pole. A ball 24 is attached to the other end of the cord 14.

A length of plastic tubing 18 is also provided to prevent wear of the cord in the region of the spiral or the like and to stiffen the cord in the vicinity of the spiral to prevent its becoming snagged in the coils of the spiral.

As mentioned above, the ferrule may be made from a brightly coloured material so that it is easily visible to the players so that they may know the exact location of the device in relation to the other components of the game, such as, for example, the spiral.

In FIG. 2 a pole 20 carries a spiral 22 on which the anchoring device travels up or down, according to which direction the ball is struck. The pole 20 is pushed in to the ground.

Reverting to FIG. 1, the width of the ferrule 10 at its open end should be greater than the pitch of the spiral.

FIG. 3 shows an alternative arrangement for the game in which there is a solid spiral 30 and the cord is attached to a ring 32 which may be large and coloured to constitute the prominent visual marker.

In FIG. 4 the spiral 40 moves and the cord 14 and ferrule 10 do not move relatively to the pole in the vertical plane.

In FIG. 5 the spiral 50 moves on the pole and is supported by a protrusion 52. The cord 14 is attached to an extension of the two ends of the spiral. The end of the protrusion 52 is provided with a prominent visual marker formation 54.

We claim:

1. An anchoring device for a captive ball and cord in a game comprising a stand supporting a spiral and a ball on one end of a cord, means interconnecting the other end of the cord and the spiral for vertical movement of said spiral and said other end of the cord relative to each other upon rotation of the ball around the stand, and an enlarged member on said other end of said cord adjacent but outside said spiral, said enlarged member having a diameter greater than the distance apart of the coils of the spiral so as to prevent the cord from becoming snagged in the coils of the spiral and to provide a prominent visual indication to the players of the game of the relative position of the cord and the spiral.

2. An anchoring device as claimed in claim 1, in which said enlarged member comprises a hollow conical ferrule adapted to receive a knot of the doubled-back end of the cord in wedging relationship.

* * * * *